US008081134B2

(12) United States Patent
Raby et al.

(10) Patent No.: US 8,081,134 B2
(45) Date of Patent: Dec. 20, 2011

(54) RHOMBOIDAL SHAPED, MODULARLY EXPANDABLE PHASED ARRAY ANTENNA AND METHOD THEREFOR

(75) Inventors: Scott A. Raby, Redmond, WA (US); Robert T. Worl, Maple Valley, WA (US); Dan R. Miller, Puyallup, WA (US); David L. Mohoric, Auburn, WA (US); Randy L. Ternes, Seattle, WA (US)

(73) Assignee: The Boeing Company, Chicago, IL (US)

( * ) Notice: Subject to any disclaimer, the term of this patent is extended or adjusted under 35 U.S.C. 154(b) by 1112 days.

(21) Appl. No.: 11/856,420

(22) Filed: Sep. 17, 2007

(65) Prior Publication Data

US 2009/0135085 A1 May 28, 2009

(51) Int. Cl.
*H01Q 21/00* (2006.01)

(52) U.S. Cl. ..... 343/853; 343/700 MS

(58) Field of Classification Search ..... 343/700 MS, 343/853

See application file for complete search history.

(56) References Cited

U.S. PATENT DOCUMENTS

| | | | | |
|---|---|---|---|---|
| 5,132,648 | A * | 7/1992 | Trinh et al. | 333/128 |
| 5,276,455 | A | 1/1994 | Fitzsimmons et al. | |
| 5,502,889 | A | 4/1996 | Casson et al. | |
| 5,688,584 | A | 11/1997 | Casson et al. | |
| 5,886,671 | A | 3/1999 | Riemer et al. | |
| 6,424,313 | B1 | 7/2002 | Navarro et al. | |
| 6,580,402 | B2 | 6/2003 | Navarro et al. | |
| 6,621,470 | B1 | 9/2003 | Boeringer et al. | |
| 6,670,930 | B2 | 12/2003 | Navarro | |
| 6,900,765 | B2 | 5/2005 | Navarro et al. | |
| 6,924,765 | B2 | 8/2005 | Ro et al. | |
| 6,989,791 | B2 | 1/2006 | Navarro et al. | |
| 7,187,342 | B2 | 3/2007 | Heisen et al. | |
| 7,423,601 | B2 | 9/2008 | Brown et al. | |
| 2008/0106484 | A1 | 5/2008 | Navarro et al. | |

FOREIGN PATENT DOCUMENTS

| | | | |
|---|---|---|---|
| JP | 53024251 | | 8/1976 |
| JP | 09130319 | | 10/1995 |
| JP | 2000228606 | | 2/1999 |
| JP | 2001007628 | A * | 1/2001 |
| WO | WO 01/01517 | | 1/2001 |
| WO | WO 2004/051805 | | 6/2004 |

* cited by examiner

*Primary Examiner* — Dieu H Duong
(74) *Attorney, Agent, or Firm* — Harness, Dickey & Pierce, P.L.C.

(57) ABSTRACT

A modularly expandable, phased array antenna having a rhomboidal shaped antenna aperture formed by a plurality of rhomboidal shaped subarrays. Each subarray has a rhomboidal shaped printed wiring board on which is formed a plurality of antenna elements, where the elements collectively form a rhomboidal shape in accordance with the printed wiring board. The rhomboidal shaped subarrays enable a modular aperture to be formed without producing any gaps between columns or rows of adjacently positioned subarrays. Thus, a uniform, consistent spacing is maintained between all the antenna elements on the subarrays. This improves antenna radiation and low observability performance for the antenna system, as well as reducing the overall size of the antenna aperture and its cost of construction.

14 Claims, 7 Drawing Sheets

FIG 5
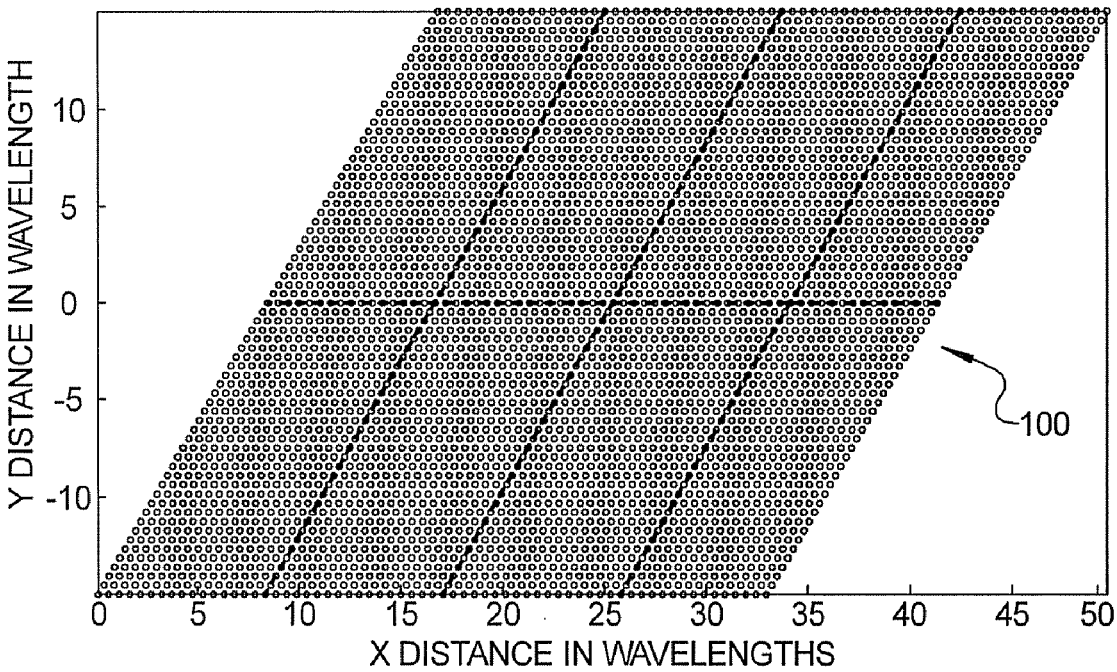
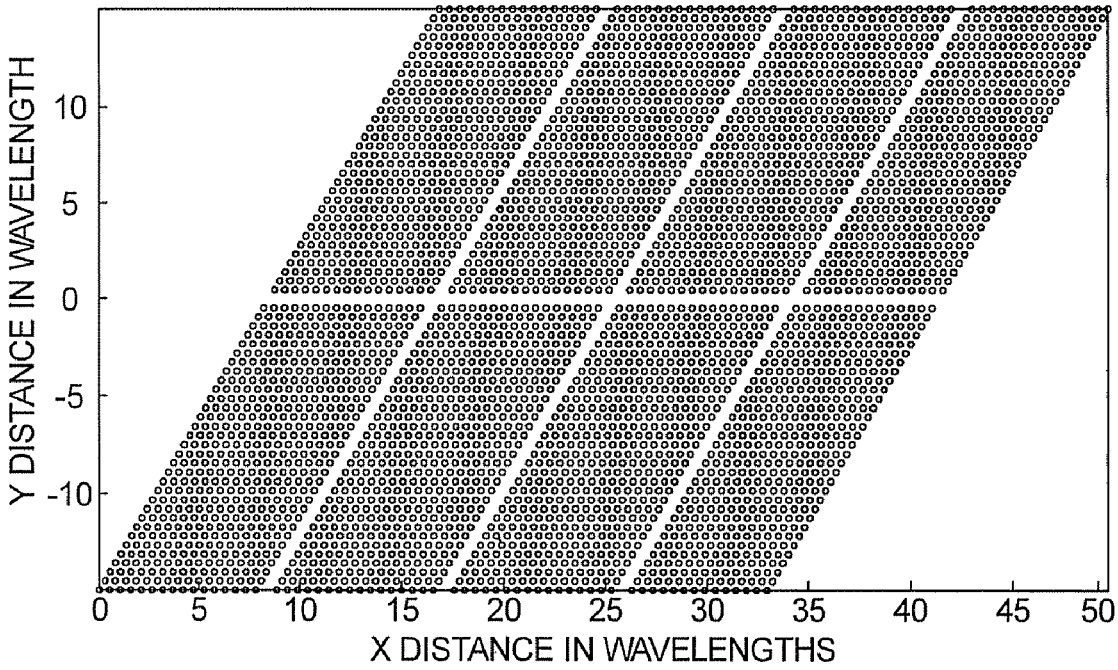
FIG 6
PRIOR
ART

RHOMBOIDAL SHAPED, MODULARLY EXPANDABLE PHASED ARRAY ANTENNA AND METHOD THEREFOR

FIELD

The present disclosure relates to antennas, and more particularly to a modularly expandable phased array antenna having a rhomboidal shaped antenna aperture.

BACKGROUND

Active phased array antennas are capable of forming one or more antenna beams of electromagnetic energy and electronically steering the beams to targets, with no mechanical moving parts involved. A phased array has many advantages over other types of mechanical antennas, such as dishes, in terms of beam steering agility and speed, having a low profile, low observability (LO) and low maintenance.

A beam-forming network is a major and critical part of a phased array antenna, responsible for collecting all the electromagnetic signals from the array antenna modules and combining them in a phase coherent way for the optimum antenna performance. One major component of the beam forming network is the antenna aperture. In large phased array antennas the antenna aperture is usually comprised of a plurality of smaller subarrays of antenna elements. The use of a plurality of subarrays eases manufacturing constraints on the beam-forming network, allows the antenna to be dynamically reconfigured, and allows for scaleable designs.

In high frequency phased array antennas, however, space constraints often mean that entire rows or columns of antenna elements must be eliminated to accommodate additional subarrays, thus creating gaps between antenna elements. Put differently, the uniform row and column spacing between array elements in a given subarray is disrupted once two or more subarrays are configured to form the antenna aperture, and this disruption is manifested by the gaps between rows and/or columns of antenna elements where two or more subarrays meet. This is especially so for rhombic shaped antenna apertures, where the gaps around the periphery of each subarray, when two or more subarrays are positioned adjacent each other, have made antenna aperture design challenging.

The above-described gaps between rows and/or columns of antenna elements can have a detrimental impact on antenna performance. This may result in antenna pattern degradation and an increased radar cross section for the antenna aperture.

SUMMARY

The present disclosure is directed to a phased array antenna and method in which the antenna aperture has a rhomboidal shape. The antenna is modularly expandable and does not present gaps between rows and/or columns of antenna elements when a plurality of subarrays are used to form a single, enlarged antenna aperture.

In one embodiment the antenna aperture includes a plurality of antenna elements arranged in a rhomboidal shape on a rhomboidal shaped printed wiring board. A connector electrically and mechanically couples to the printed wiring board along a peripheral edge portion of the printed wiring board for supplying power and logic signals to the printed wiring board. By coupling to the peripheral edge portion of the printed circuit board, an additional rhomboidal shaped printed circuit board may be positioned adjacent the printed circuit board without forming any gaps in the rows and/or columns of antenna elements that form the rhomboidal shaped array of antenna elements.

In another embodiment a rhomboidal shaped phased array antenna is formed having a plurality of rhomboidal shaped printed wiring boards. Each of the printed wiring boards has a plurality of antenna elements formed thereon in a rhomboidal shape. Each printed wiring board has an electrical connector coupled along a peripheral edge portion. The printed wiring boards can be positioned in abutting relationship without creating any gaps in the rows or columns of antenna elements on the printed wiring boards. A bus bar may be coupled to the connectors to supply power, logic signals, or both, to the printed wiring boards. The antenna aperture is modularly expandable and the addition of further printed wiring boards does not create gaps between rows or columns of adjacently positioned printed wiring boards.

In one implementation a method for forming a phased array antenna is presented. The method may involve forming a printed wiring board in a rhomboidal shape and forming a plurality of antenna elements in a rhomboidal configuration on the printed circuit board. A connector is coupled to the edge of the printed wiring board. Additional printed wiring boards may be positioned adjacent to the one printed wiring board to form a modularly expandable antenna aperture that has uniform, consistent spacing of antenna elements with no gaps between rows or columns of antenna elements on adjacent printed wiring boards.

In various embodiments and implementations the antenna system makes use of a cold plate on which the one or more printed wiring boards are mounted. A coolant is circulated through the cold plate to assist in cooling the printed wiring boards and associated antenna elements.

The features, functions and advantages that have been discussed can be achieved independently in various embodiments of the present disclosure or may be combined in yet other embodiments, further details of which can be seen with reference to the following description and drawings.

BRIEF DESCRIPTION OF THE DRAWINGS

The drawings described herein are for illustration purposes only and are not intended to limit the scope of the present disclosure in any way.

FIG. 5 is a simplified illustration of a layout of an antenna aperture in accordance with the present disclosure, where the aperture has 4096 antenna elements on eight adjacently placed printed wiring boards, and illustrating no gaps between the rows or columns of the antenna elements;

FIG. 6 is a prior art rhomboidal shaped phased array antenna having 4096 antenna elements formed on eight printed wiring boards, illustrating the gaps between rows and columns of antenna elements that exist with the prior art configuration of such an antenna;

DETAILED DESCRIPTION

The following description is merely exemplary in nature and is not intended to limit the present disclosure, application, or uses.

Figure 1:
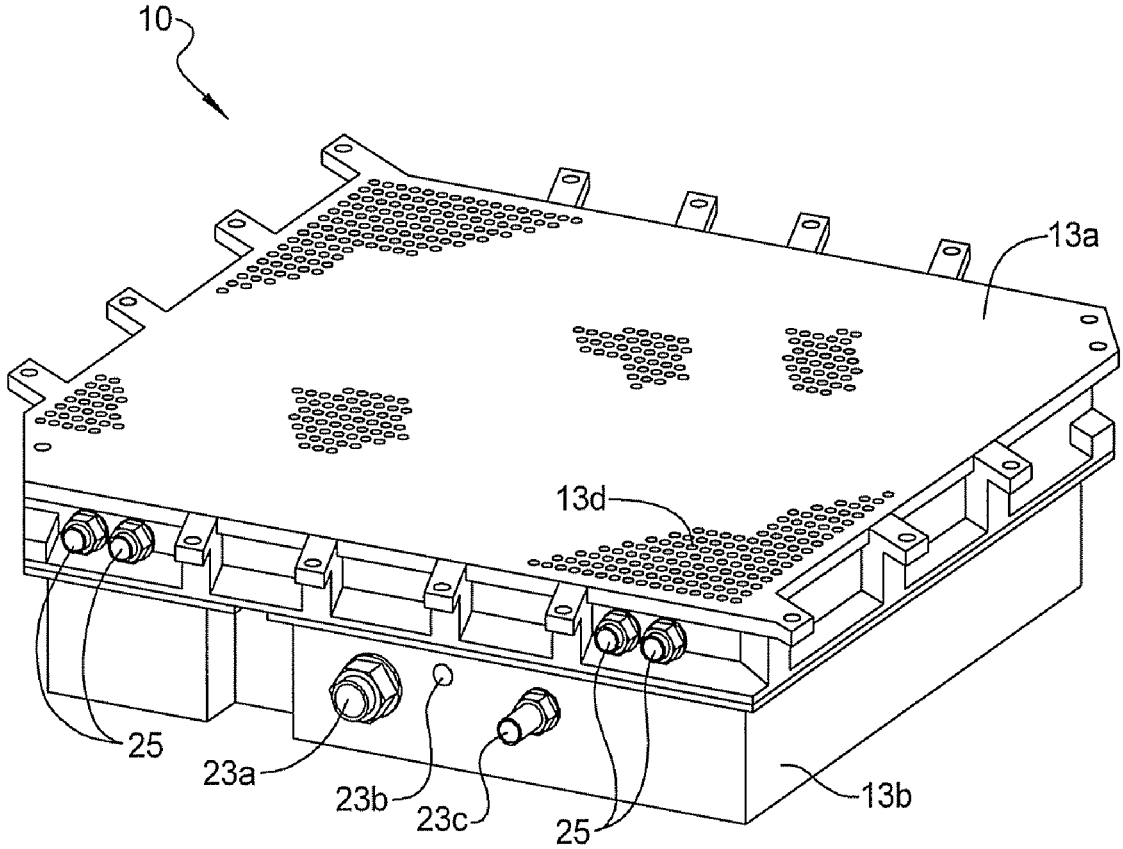
FIG. 1 is an assembled perspective view of one embodiment of a phased array antenna in accordance with an embodiment of the present disclosure.
Figure 2:
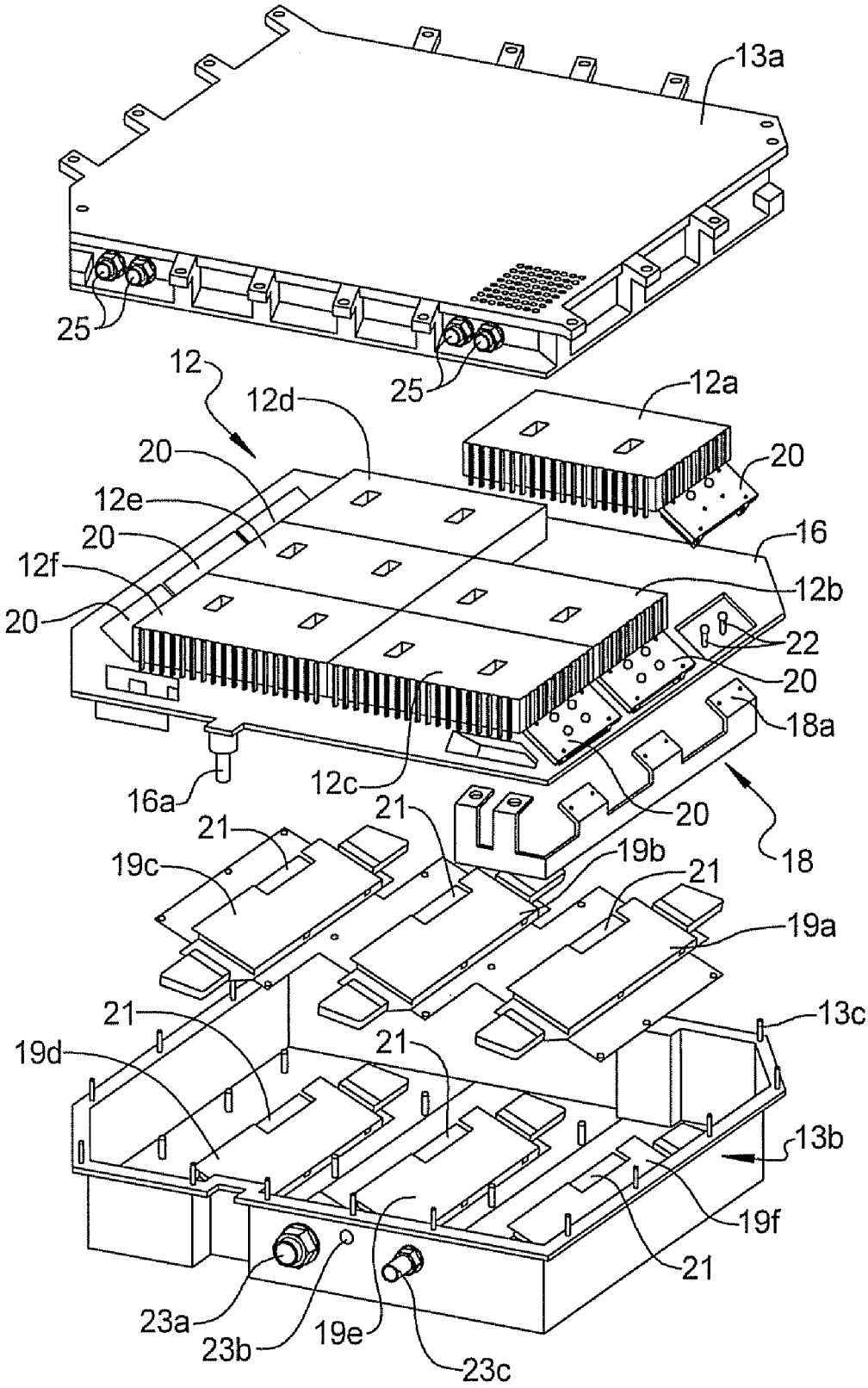
FIG. 2 is a top, partially exploded perspective view of the phased array antenna of FIG. 1 more fully illustrating the internal components thereof.
Figure 3:
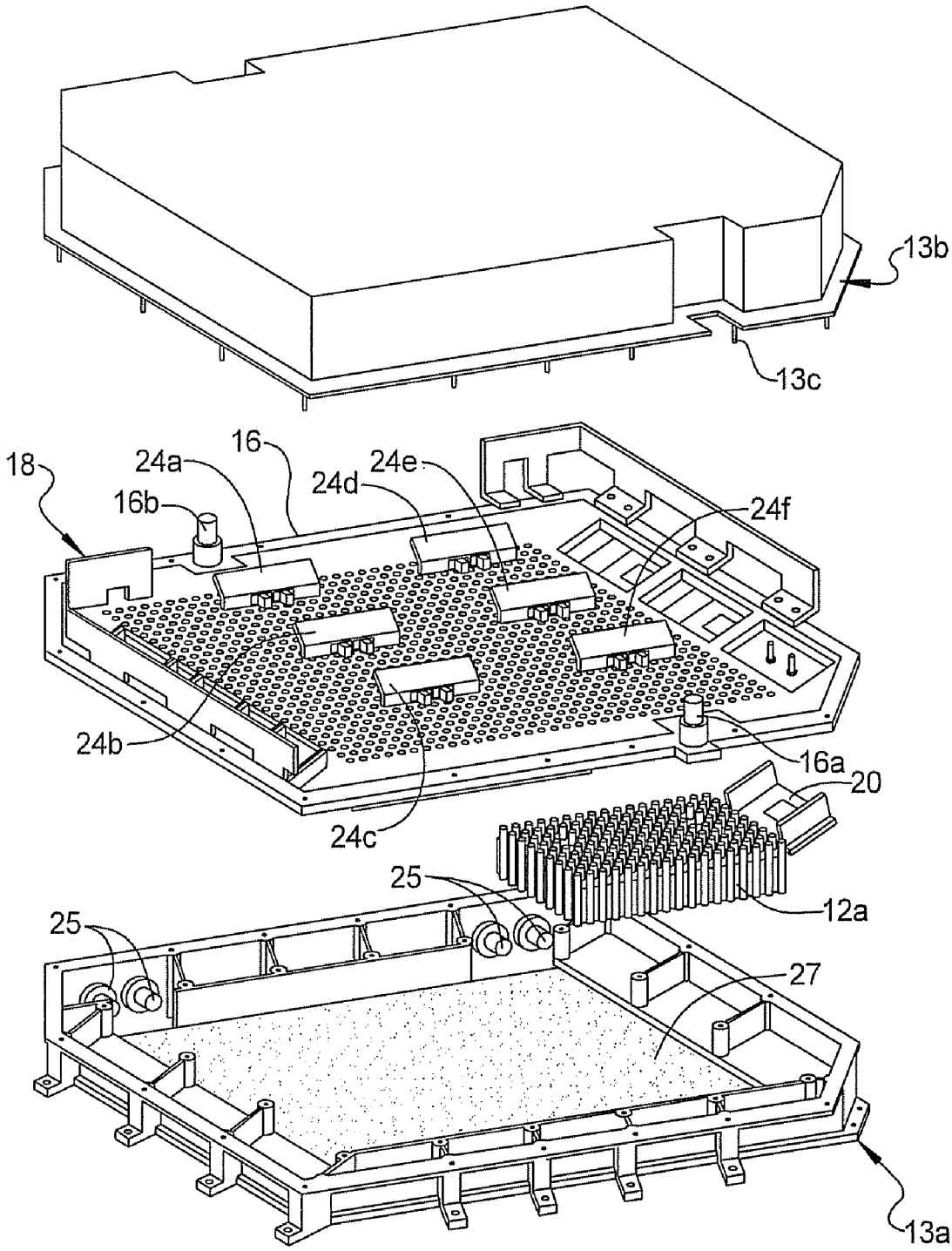
FIG. 3 is the same view of the antenna as in FIG. 2 but from a bottom perspective.

Referring to FIGS. 1-3, there is shown a rhomboidal shaped phased array antenna 10 in accordance with one embodiment of the present disclosure. The antenna 10 includes a rhomboidal shaped antenna aperture 12 that is in communication with a power and electronics subsystem 14 (visible in FIG. 2 only). The aperture 12 in this example includes six independent, rhomboidal shaped, multi-layer printed wiring boards that form six independent antenna subarrays 12*a*-12*f*. For convenience, these printed wiring board subarrays will be referred to throughout the following description simply as "subarrays 12*a*-12*f*", with the understanding that each includes a rhomboidal shaped printed wiring board with antenna elements configured in an overall rhombic shape thereon. The subarrays 12*a*-12*f* are positioned contiguously to form a single, large array of modules.

Referring specifically to FIGS. 1 and 3, the aperture 12 is enclosed within an enclosure comprised of an aluminum honeycomb cover 13*a* and an aluminum housing 13*b* that are secured together via suitable fasteners, such as threaded fasteners 13*c* (the fasteners being visible only in FIG. 3). The honeycomb cover 13*a* essentially forms an aluminum plate with a plurality of circular waveguides 13*d* arranged in a triangular lattice pattern, as is conventional with phased array antenna construction. The circular waveguides 13*d* are filled with dielectric plugs. The dielectric plugs may be formed from REXOLITE® dielectric material or any suitable equivalent material. The antenna elements on each subarray 12*a*-12*f* are spaced in accordance with the frequency band that the antenna 10 will be operated in, which in this example is approximately ½ wavelength spacing. The circular waveguides 13*d* in the aluminum honeycomb cover 13*a* are arranged to lay directly over the antenna elements, as is standard in phased array antenna construction.

In FIGS. 2 and 3 the aluminum honeycomb cover 13*a* has been removed to better illustrate the subarrays 12*a*-12*f*. In this example each subarray 12*a*-12*f* includes 496 individual radiating/reception antenna elements. In this illustration the antenna elements are too small to be individually noted. Each subarray 12*a*-12*f* essentially has room for 512 individual antenna elements, but 16 elements are eliminated on each subarray 12*a*-12*f* to make room for radio frequency (RF) and mechanical connections to each subarray 12*a*-12*f*. The subarrays 12*a*-12*f* form a single, large modular antenna aperture that does not have any gaps between rows or columns of the antenna elements.

The subarrays 12*a*-12*g* are supported on a conventional cold plate 16 having an inlet 16*a* and an outlet 16*b*. A coolant may be flowed into the inlet 16*a* and circulated through the cold plate 16 to assist in drawing heat from the subarrays 12*a*-12*f* so as to help cool them during operation, as is well known in phased array antenna construction. A bus bar 18 extends around the perimeter of the cold plate 16 and is coupled to a connector circuit board 20 coupled to each subarray 12*a*-12*f* by threaded fasteners 22 that extend through openings 18*a* in the bus bar 18. The bus bar 18 may be used to supply power (e.g., DC power) to each of the subarrays 12*a*-12*f*. As will be apparent from FIGS. 2 and 3, it is an advantage that the bus bar 18 does not need to extend between any pair of adjacent subarrays 12*a*-12*f*, and therefore does not create any gaps between rows and columns of adjacently placed subarrays 12*a*-12*f*.

With further reference to FIG. 2, the power and electronics subsystem 14 in this embodiment is made up of six beam steering controller boards 19*a*-19*f* that are electrically coupled to the subarrays 12*a*-12*f*, respectively. The beam steering controller boards 19*a*-19*f* each typically may include one or more field programmable gate arrays (FPGAs) (not shown) that provide the electrical control and logic signals to control beam steering for its respective subarray 12*a*-12*f*. Ribbon cables (not shown) may be used to couple edge connector portions 21 of each beam steering controller board 19 to its respective connector circuit board 20. Each of the beam steering controller boards 19*a*-19*f* may be physically secured within the aluminum housing 13*b* by threaded fasteners or any other suitable means. The aluminum housing has an input port 23*a* for feeding in −5/12 VDC power to the internal electronic components, an RF input port 23*b* for supplying an RF signal, and an input 23*c* for supplying control signals to the beam steering controller boards 19*a*-19*f*. The aluminum honeycomb cover 13*a* includes inputs 25 for feeding +5 VDC into the internal components of the antenna 10.

With further reference to FIG. 3, a plurality of RF amplifiers 24*a*-24*f*, each operatively associated with a respective one of the subarrays 12*a*-12*f*, may be secured to an undersurface 16*a* of the cold plate 16 so as to also be cooled by the cold plate. The RF amplifiers 24*a*-24*f* are in communication with the power and electronics subsystem 14 and amplify signals received by the antenna aperture 12. A conduction gasket 27 may be laid against an inner surface of the aluminum honeycomb cover 13*a*. The conduction gasket 27 ensures that each antenna element is properly grounded to an associated circular waveguide 13*d* in the aluminum honeycomb cover 13*a*. The gasket 27 also compensates for variations in height between the subarrays 12*a*-12*f* to allow for correct transmission of electromagnetic signals. The gasket 27 effectively grounds the flanges together so that an electromagnetic wave may propagate through the waveguides 13*d* with an acceptable amount of reflection at the interface. In the context of a phased array antenna, this interface also reduces mutual coupling between adjacent array elements (i.e., adjacent waveguides) caused by surface waves that would otherwise propagate if no ground existed.

Figure 4:
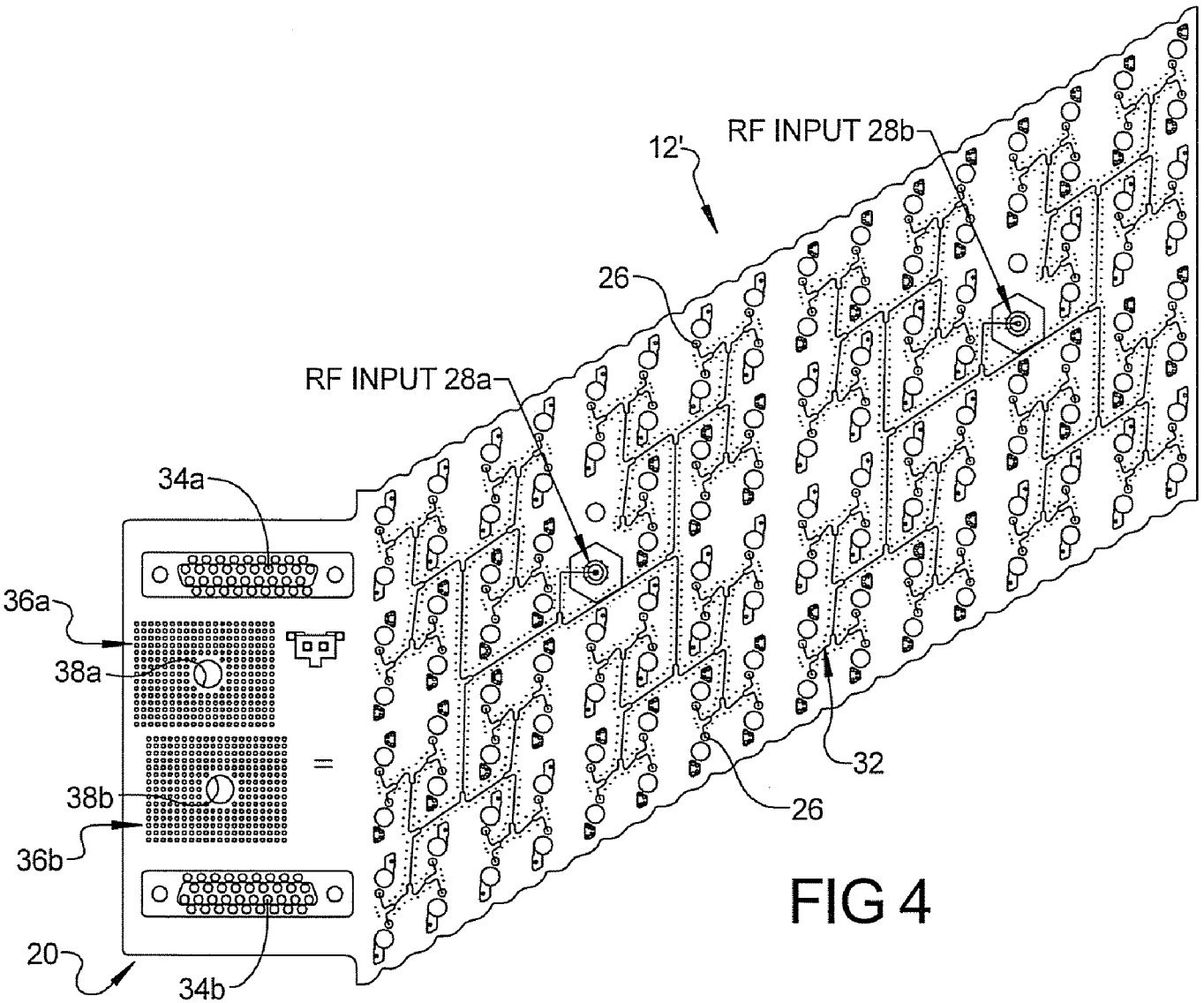
FIG. 4 is a layout of an RF distribution network for the RF layer of an exemplary rhomboidal shaped printed wiring board of the antenna, in this example containing 124 antenna elements, and where the illustrated printed wiring board may form one subarray of a larger, modular antenna aperture.

With reference to FIG. 4, the connector circuit board 20 and an exemplary layout of antenna elements for a 496 element subarray (labeled 12') is shown. RF Input ports 28*a* and 28*b* each distribute the RF signals to 248 antenna elements.

The antenna elements on the 496 element subarray 12' are labeled with reference numeral 26. Sixteen antenna elements are missing so that the two RF input ports 28*a* and 28*b* and mechanical fasteners can be formed on the subarray 12' , and two holes 38*a* and 38*b* provided for connecting the bus bar 18 to the subarray 12' through openings in the bus bar 18*a* (the openings 18*a* being visible in FIG. 2). The RF input ports 28*a* and 28*b* enable the RF signal energy to be distributed by an n-way distribution network 32 to each of the antenna elements 26 when the subarray is functioning in a transmit mode. In the present implementation, "n" is 248. However, it will be appreciated while this example shows 248 antenna elements 26 that are part of a 248-way distribution network, that a greater or lesser number of antenna elements could be used to form different n-way distribution networks, depending on the overall size of the subarray that is needed.

The connector circuit board 20 in FIG. 4 may form an integral portion of the subarray 12' and may include a pair of D-sub style electrical connectors 34*a* and 34*b* for coupling to the electronics subsystem 14 and enabling logic and control signals to be provided to the antenna elements 26. Two groups of vias 36*a* and 36*b* provide current carrying conductors for supplying high current DC signals to a power plane (not shown) of the subarray 12'. The holes 38*a* and 38*b* enable physical connection to the bus bar 18 by way of screws 22 that extend through holes 18*a* in the bus bar 18.

The printed wiring boards and the vias 36*a* and 36*b* used to implement the antenna 10 may be constructed in accordance with the methods disclosed in U.S. Pat. No. 6,424,313, owned by The Boeing Company ("Boeing"), which is hereby incorporated by reference into the present application. The disclosures of U.S. patent application Ser. No. 11/140,758, filed May 31, 2005; Ser. No. 11/594,388 filed Nov. 8, 2006; Ser. No. 11/609,806 filed on Dec. 12, 2006; Ser. No. 11/608,235 filed Dec. 7, 2006; and Ser. No. 11/557,227 Nov. 7, 2006, all of which are assigned to Boeing, involve various details of antenna construction that may also be of general interest to the reader, and these applications are also hereby incorporated by reference into the present disclosure.

In a transmit phase of operation, electrical signal energy is distributed to the RF input ports 28*a* and 28*b*, through the n-way distribution network 32, and to the antenna elements 26 where the electrical signal energy is radiated as RF energy. In a receive operation, the above-described operation is reversed, such that the antenna elements receive the RF energy and generate corresponding electrical signals that are combined, using the n-way distribution 32, and input to the RF input ports 28*a* and 28*b*.

It is a principal advantage of the antenna system 10 that the rhombic shape of the aperture 12 is able to be constructed without forming any gaps between rows or columns of the antenna elements. Referring to FIG. 5, another illustration of an antenna aperture 100, this time a 4096 element aperture made up of eight independent subarrays, is shown. The aperture forms a rhomboidal shape with no gaps between any of the adjacently positioned subarrays. FIG. 6 illustrates a prior art 4096 element, eight subarray aperture, where gaps are present between rows and columns of the antenna elements. The gaps are undesirable as they significantly increase the magnitude of the sidelobes of the antenna pattern produced by the aperture.

Figure 7:
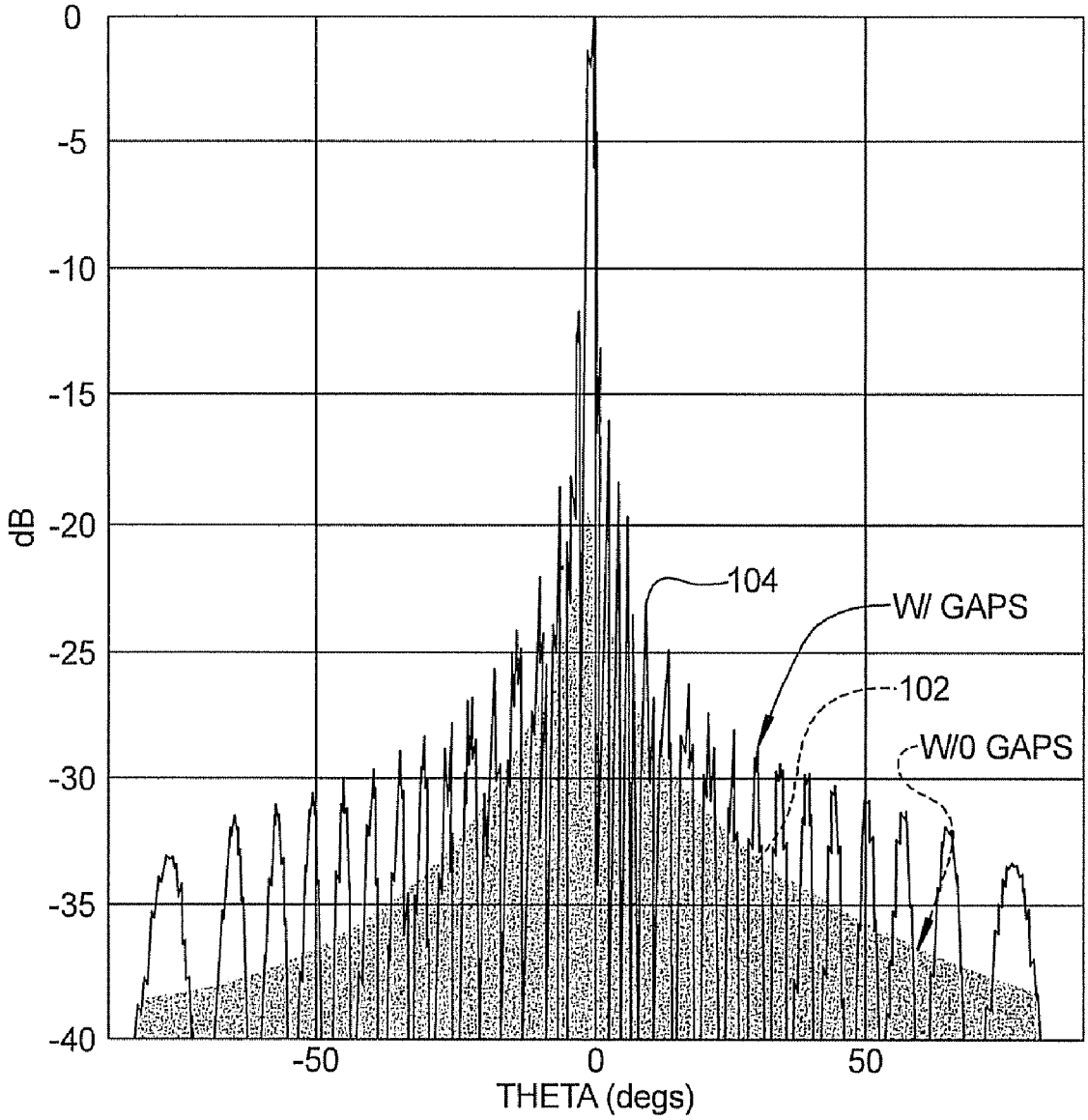
FIG. 7 shows two graphs that illustrate the antenna side lobe performance reduction for a rhombic shaped 4096 element phased array antenna of the present disclosure as compared to a prior art, 4096 element rhombic shaped phased array antenna.

FIG. 7 illustrates two graphs 102 and 104 of antenna patterns, where graph 102 was produced by the 4096 element array 100 shown in FIG. 5 and graph 104 was produced by the prior art 4096 element array of FIG. 6. The graph 102 for the 4096 element array 100 of FIG. 5 has significantly lower sidelobes than the graph 104. The graph 102 shows the boresight antenna pattern as cut through a cardinal plane (i.e., the plane running parallel to the rhomboid formed by the array 100). Theta represents the angular position of the measurement relative to boresight (i.e., at 0 degrees scan angle). The amplitudes of the sidelobes are measured relative to the boresight value, which has been normalized to 0 dB for both antenna patterns.

Figure 8:
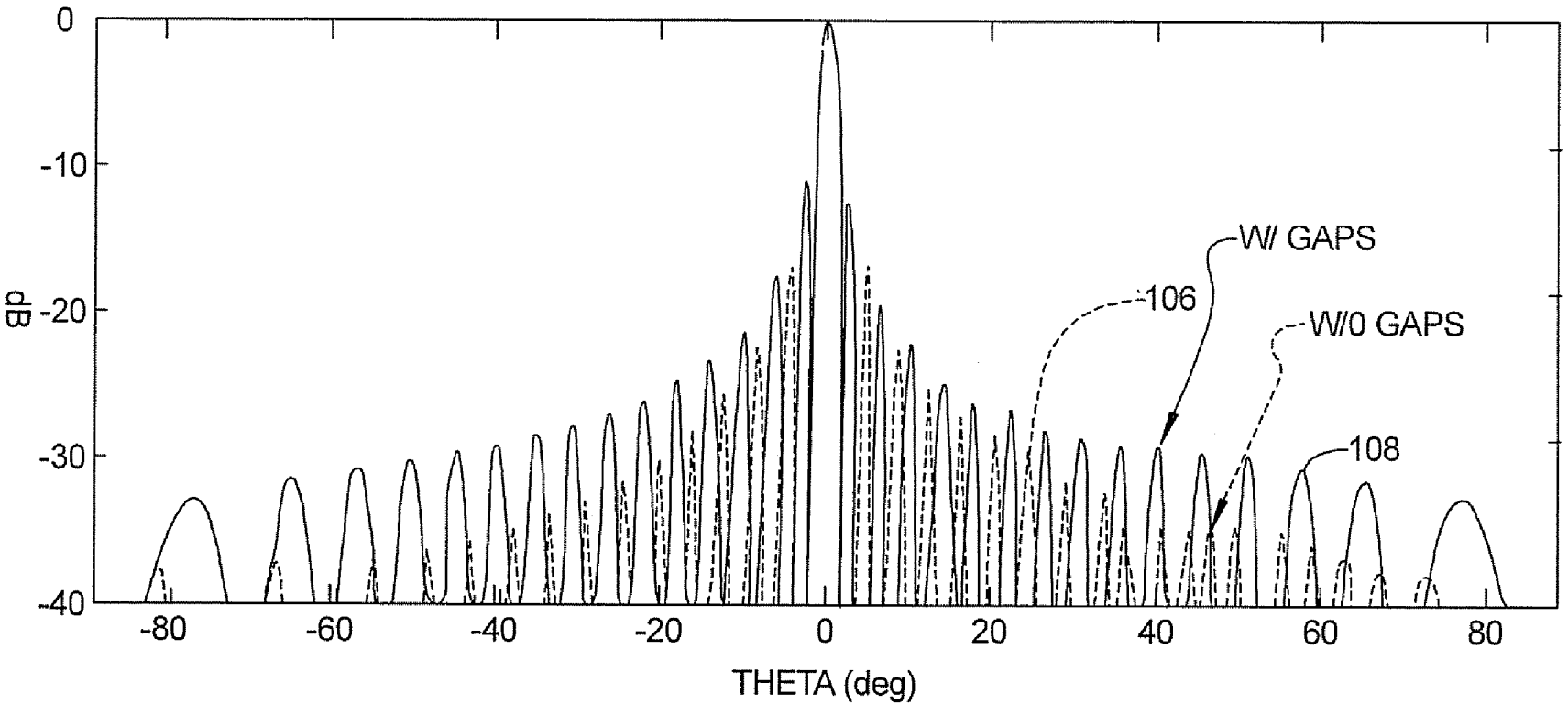
FIG. 8 illustrates two antenna sidelobe performance graphs similar to FIG. 7, showing a comparison between a rhomboidal shaped 2048 element antenna aperture of the present disclosure and a prior art, 2048 element antenna aperture.

FIG. 8 illustrates a graph of an antenna pattern of a 2048 element phased array antenna constructed in accordance with the present disclosure, and denoted by reference numeral 106, and a typical antenna output pattern 108 for a prior art, 2048 element phased array antenna. Again, the reduction in sidelobes (as indicated by the lower dB levels) for the pattern 106 is significant when compared with the dB levels of the antenna output pattern 108 for the same element-size prior art antenna aperture. Again, the X-axis denotes the angular position of the measurement relative to the boresight of the array 106.

The construction of the rhomboidal shaped antenna apertures 12 and 100 described herein also provides the important advantage of not requiring the use of any non-active (i.e., "dummy") antenna elements, which would form gaps around the peripheral edges of a subarray when the subarray is positioned next to one or more other subarrays of the same construction to form a larger aperture. The elimination of non-active antenna elements improves both the antenna radiation and the low observability (LO) performance of the antenna aperture 12. As will be appreciated, improving the low observability (LO) performance of a phased array antenna is an important consideration in military applications. The rhomboidal shaped antenna apertures 12 and 100 result in an antenna aperture having reduced overall dimensions, reduced weight and reduced cost, as compared to prior art rhomboidal shaped aperture designs incorporating non-active antenna elements.

While various embodiments have been described, those skilled in the art will recognize modifications or variations which might be made without departing from the present disclosure. The examples illustrate the various embodiments and are not intended to limit the present disclosure. Therefore, the description and claims should be interpreted liberally with only such limitation as is necessary in view of the pertinent prior art.

What is claimed is:

1. A phased array antenna aperture comprising:

a plurality of antenna elements arranged in a rhomboidal shape on a rhomboidal shaped printed wiring board;

a connector electrically and mechanically coupled to said printed wiring board along and extending laterally from a peripheral edge portion of the printed wiring board for supplying power and logic signals to said printed wiring board;

further comprising an additional plurality of printed wiring boards each having an additional plurality of antenna elements thereon, each said additional printed wiring board also having a rhomboidal shape and an associated connector extending laterally from a peripheral edge portion thereof, said printed wiring board and said additional printed wiring boards that each is a subarray abutted against edges of one another to form an enlarged antenna aperture without a gap between rows or columns of said additional antenna elements and said antenna elements; and a bus bar extending along at least a portion of a periphery for communicating with said connectors to supply power to said printed wiring board and said additional printed wiring boards without creating gaps between rows or columns of adjacently placed subarrays.

2. The antenna aperture of claim 1, further comprising a cold plate for supporting said printed wiring board and cooling said printed wiring board.

3. The antenna aperture of claim 1, further comprising a radio frequency (RF) amplifier coupled to a surface of said printed wiring board.

4. A rhomboidal shaped phased array antenna comprising:

a first printed wiring board arranged in a rhomboidal shape and having a first plurality of antenna elements formed thereon, said first plurality of antenna elements further being arranged in said rhomboidal shape;

a first connector board extending laterally from a first edge of said first printed wiring board;

a second printed wiring board arranged in a rhomboidal shape and having a second plurality of antenna elements formed thereon, said second plurality of antenna elements further being arranged in said rhomboidal shape;

a second connector board extending laterally from coupled to a first edge of said second printed wiring board;

said second printed wiring board further being abutted against said first printed wiring board such that said first and second pluralities of antenna elements that are each a subarray form a uniform, contiguous array of elements with uniform, consistent spacing between said array of elements, and with said first and second connector boards extending from a common peripheral edge of said first and second printed wiring boards and being configured to supply power and logic signals to their respective said printed wiring boards; and a power bus bar arranged along a common periphery of said first and second connectors and physically attached to said first and second connector boards for supplying power to said first and second printed wiring boards without creating gaps between rows or columns of adjacently placed subarrays.

5. The antenna of claim 4, wherein said first and second connectors each comprise connectors that couple direct current (DC) power from said power bus bar to said first and second printed wiring boards, respectively.

6. The antenna of claim 4, further comprising a cold plate for supporting said printed wiring boards thereon, and wherein said cold plate is adapted to circulate a coolant therethrough to assist in cooling said printed wiring boards.

7. The antenna of claim 4, further comprising a first radio frequency (RF) amplifier coupled to said first printed wiring board, and a second RF amplifier coupled to said second printed wiring board.

8. The antenna of claim 4, wherein at least one of said first and second printed wiring boards comprises fourth hundred ninety-six independent ones of said antenna elements, and two RF coupling connectors.

9. The antenna of claim 4, wherein said antenna is modularly expandable to accommodate additional, non-square shaped printed wiring boards while maintaining said uniform, consistent spacing between all of said array elements.

10. A method for forming a rhomboidal shaped phased array antenna, comprising forming a first printed circuit board in a rhomboidal shape and with a peripheral edge;

forming a first array of antenna elements on said printed circuit board in a uniform pattern having an overall rhomboidal shape; and coupling a first electrical connector, extending laterally from a first edge of said first printed wiring board, along said peripheral edge of said printed wiring board;

forming a second printed wiring board in a rhomboidal shape, and with a peripheral edge;

forming a second array of antenna elements on said second printed wiring board in a uniform pattern having an overall rhomboidal shape;

coupling a second electrical connector, extending laterally from a first edge of said second printed wiring board, on said peripheral edge of said second printed wiring board;

locating said second printed wiring board in abutting relationship with said first printed wiring board such that said printed wiring boards cooperatively form a modular, enlarged antenna aperture having a uniform array of antenna elements with consistent, uniform spacing there between, and such that said electrical connectors extend from a common peripheral edge of said first and second printed circuit boards and are adapted to supply power and logic signals to respective said printed wiring boards, and do not interfere with abutting placement of said printed wiring boards; and locating a power bus along a common periphery of said first and second electrical connectors and physically attaching said power bus to said first and second connector boards to supply power to said first and second printed wiring boards without creating gaps between rows or columns of adjacently placed subarrays.

11. The method of claim 10, further comprising:

disposing a bus bar adjacent said common peripheral edges of said first and second printed wiring boards;

coupling said bus bar to said first and second electrical connectors of said printed wiring boards; and using said bus bar to transfer power to said printed wiring boards.

12. The method of claim 11, further comprising:

disposing said printed wiring boards on a cold plate; and circulating said a coolant through said cold plate to assist in cooling said printed wiring boards.

13. The method of claim 11, further comprising:

disposing a bus bar adjacent said peripheral edges of said first and second printed wiring boards;

coupling said bus bar to said electrical connectors of said printed wiring boards; and using said bus bar to transfer power to said printed wiring boards.

14. The method of claim 11, further comprising coupling a radio frequency (RF) amplifier to said printed wiring board.

* * * * *